US007650709B2

(12) United States Patent
Kim et al.

(10) Patent No.: US 7,650,709 B2
(45) Date of Patent: Jan. 26, 2010

(54) AIR CONDITIONER

(75) Inventors: Ji Hoon Kim, Jinhae-si (KR); Joong Gil Yoo, Seongnam-si (KR); Ki Jong Yoo, Seoul (KR); Hee Jae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 529 days.

(21) Appl. No.: 11/326,395

(22) Filed: Jan. 6, 2006

(65) Prior Publication Data

US 2006/0185381 A1 Aug. 24, 2006

(30) Foreign Application Priority Data

Feb. 23, 2005 (KR) ..... 10-2005-0015160

(51) Int. Cl.
*A47G 1/06* (2006.01)

(52) U.S. Cl. ..... 40/725; 40/724; 40/711; 62/263

(58) Field of Classification Search ..... 40/724, 40/725, 711, 541, 564; 62/263
See application file for complete search history.

(56) References Cited

U.S. PATENT DOCUMENTS 4,583,309 A * 4/1986 Kane et al. ..... 40/711
4,733,542 A * 3/1988 Blair ..... 62/263
5,373,654 A * 12/1994 Whalen ..... 40/716
5,987,908 A * 11/1999 Wetzel ..... 62/259.1
6,018,955 A * 2/2000 Kaneko et al. ..... 62/125
2002/0189274 A1* 12/2002 Lee et al. ..... 62/298

FOREIGN PATENT DOCUMENTS

| | | | |
|---|---|---|---|
| CN | 200958802 | Y | 10/2007 |
| EP | 1271065 | A2 | 1/2003 |
| JP | 03213921 | A * | 9/1991 |
| JP | 10-89743 | A | 4/1998 |
| JP | 2002-106952 | A | 4/2002 |
| JP | 2004-150717 | A | 5/2004 |
| KR | 10-2002-0033880 | | 5/2002 |
| WO | WO-03/014628 | A2 | 2/2003 |

* cited by examiner

*Primary Examiner*—Gary C Hoge
(74) *Attorney, Agent, or Firm*—Birch, Stewart, Kolasch & Birch, LLP

(57) ABSTRACT

An air conditioner is provided. In the air conditioner, a base is provided, a front frame is coupled to a front of the base and it includes a filter insertion slot in a predetermined portion, a panel member is installed to the front frame and it includes a picture or a photograph detachably attached thereto, a heat exchanger is accommodated in the base to change heat with sucked air, and a blower fan is installed behind the heat exchanger to suck indoor air.

10 Claims, 7 Drawing Sheets

AIR CONDITIONER

BACKGROUND OF THE INVENTION

1. Field of the Invention

The present invention relates to an air conditioner, and more particularly, to an air conditioner that is designed to be associated with a picture or photograph, thereby providing an improved external appearance as well as its inherent air-conditioning effect.

2. Description of the Related Art

Generally, an air conditioner is operated as a refrigerant goes through a cooling cycle having a series of processes such as a compression process, a condensing process, an expanding process, and a vaporizing process. That is, after the refrigerant is compressed to a high temperature and pressure state, heat is discharged to an outer side by a condenser. Then, the temperature and pressure of the refrigerant are lowered as it goes through an expansion valve. Then, the refrigerant goes through the vaporizer to absorb heat and returns to the condenser.

Here, the compression, condensing and expansion processes are performed in an indoor unit of the air conditioner. The vaporizing process is performed by a blower fan and a heat exchanger.

Meanwhile, the air conditioner is generally classified into a window type air conditioner that is designed to be mounted on a window and to integrate a cooling cycle device therein and a sprit air conditioner having indoor and outdoor units that are separated from each other and installed on indoor and outdoor sides, respectively.

The sprit air conditioner is further classified according to an installing method of the indoor unit into a wall-mounted type, a standing type, a ceiling-mounted type, and a ceiling-buried type.

There is also provided a convertible type indoor unit that can be used any one of the wall-mounting type, the standing type and ceiling-mounted type.

Meanwhile, the indoor unit of the air conditioner is classified according to locations of air intake and outlet into a variety of types. For example, in a type where indoor air is introduced through a side portion of the indoor unit and exhausted through a front portion of the indoor unit, a louver is installed on the front portion of the indoor unit to uniformly distribute the air in the indoor room by rotating up and down and left and right.

In the typical indoor unit of the air conditioner, the front portion is designed to simply function as a cover. That is, a front cover defining the front portion of the indoor unit functions to prevent a variety of parts such as an air intake fan, a heat exchanger and the like that are installed inside the indoor unit to be exposed outward, thereby preventing a user from getting electric shock by touching the parts installed inside the indoor unit. That is, since the front cover is designed considering only the simple functions, it cannot affect on improving the interior atmosphere.

SUMMARY OF THE INVENTION

Accordingly, the present invention is directed to an air conditioner that substantially obviates one or more problems due to limitations and disadvantages of the related art.

An object of the present invention is to provide an air conditioner that is designed to be associated with a picture or photograph, thereby providing an improved external appearance as well as its inherent air-conditioning effect.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: a base; a front frame coupled to a front of the base and including a filter insertion slot in a predetermined portion; a panel member installed to the front frame and including a picture or a photograph detachably attached thereto; a heat exchanger accommodated in the base to change heat with sucked air; and a blower fan installed behind the heat exchanger to suck indoor air.

In another aspect of the present invention, there is provided an air conditioner including: a base defining an air intake in a predetermined portion; a front frame coupled to a front of the base and defining an air outlet in a predetermined portion; a decoration panel installed to the front frame and including a picture or a photograph; and a filter detachably inserted into a predetermined portion of the front frame.

In still another aspect of the present invention, there is provided an air conditioner including: a base defining an air intake in a predetermined portion; a front frame coupled to a front of the base and defining an air outlet in a predetermined portion; and a display installed to wholly or partially cover a front surface of the front frame to display an image. According to the present invention, since an artwork or a picture can be displayed on the front portion of the indoor unit, the interior atmosphere can be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
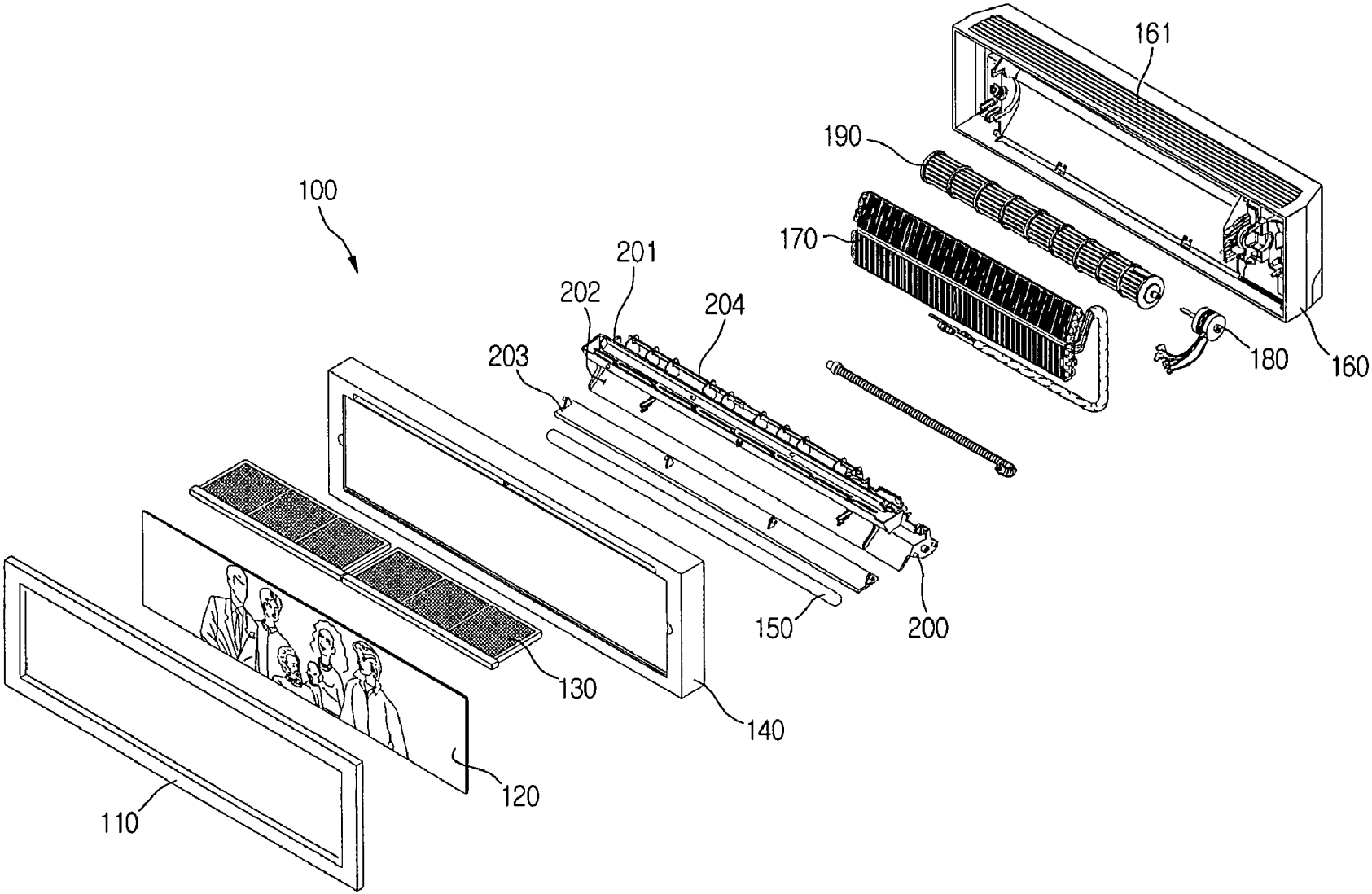
FIG. 1 is an exploded perspective view of an indoor unit of an air conditioner according to the present invention.

FIG. 1 is an exploded perspective view of an indoor unit of an air conditioner according to the present invention.

Referring to FIG. 1, an indoor unit 100 of an air conditioner includes a base 160 defining air intake 161 at an upper portion and enclosing inner components, a blower fan 190 to be installed in the base 160 to draw indoor air into the indoor unit 100, a driving motor 180 to drive the blower fan 190, a heat exchanger 170 to be placed at a front and upper side of the blower fan 190 to exchange heat with the indoor air drawn by the blower fan 190, and an air guide 200 to be installed under the heat exchanger 170 to discharge the air to the outside after the heat exchange.

The air guide 200 includes a drain pan 201 to receive water condensed on the outer surface of the heat exchanger 170, a louver 204 to control the discharging of the air in left and right directions after the air drawn by the blower fan 190 is cooled by the heat exchanger 170, a discharge grille 202 to guide the cooled air toward an air outlet to discharge the cooled air from a bottom of the indoor unit 100, and a discharge vane 203 placed in front of the discharge grille 202 to control the discharging of the cooled air in up and down directions.

The indoor unit 100 further includes a front frame 140, a luminous member 150, a filter such as a hepa filter 130, and a panel member having a decoration panel 120 and a front cover 110. When assembled, the front frame 140 is fixed to the base 160 from the front of the heat exchanger 170, and it defines an air outlet (not shown) in a bottom. The luminous member 150 is installed on a rear bottom of the front frame 140 to emit light. The hepa filter 130 is inserted to an upper portion of the front frame 140 in a horizontal direction. The decoration panel 120 is placed in front of the front frame 140 to attach a picture or photograph thereto. The front cover 110 is rotatably or detachably installed on the front frame 140.

The front cover 110 covers the decoration panel 120 to protect it and includes a front portion made of transparent material to display a picture or photograph attached to the decoration panel 120. The hepa filter 130 collects foreign substances from the air drawn through the air intake 161.

An operation of the indoor unit 100 of the air conditioner will now be described.

When a start button is pressed, the driving motor 180 is operated to rotate the blower fan 190. Upon the rotation of the blower fan 190, indoor air is sucked into the indoor unit 100 through the air intake 161 defined in the upper portion of the base 160. The sucked air as it passes through the heat exchange 170 exchanges heat with cold-state refrigerant flowing through pipe lines of the heat exchanger 170. That is, the sucked air is cooled as it passes through the heat exchanger 170.

When the driving motor 180 is operated by the pressing of the start button, the discharge grille 202 is rotated to open the air outlet. The air cooled at heat exchanger 170 is discharged from the indoor unit 100 through the air outlet back to the indoor. The discharging direction of the cool air can be adjusted by the discharge vane 203 and louver 204.

The air sucked through the air intake 161 passes through the hepa filter 130 before it passes through the heat exchanger 170, such that foreign substances such as dust can be removed from the air. The hepa filter 130 can be removed from the indoor unit 100 by pulling it out after lifting up the front cover 110. The detachment of the hepa filter 130 will be more fully described later.

Figure 2:
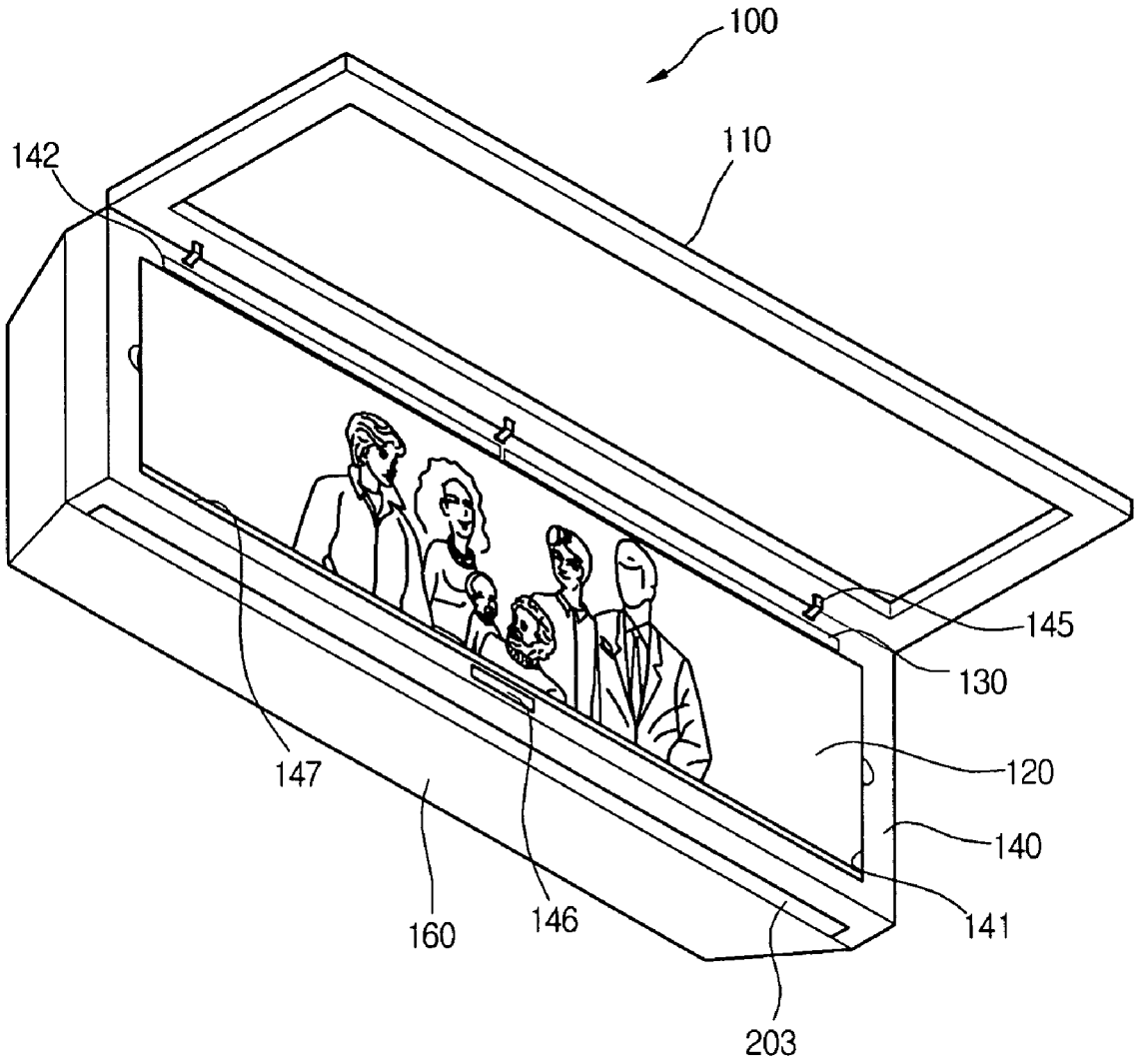
FIG. 2 shows a front structure of an indoor unit of an air conditioner according to a first embodiment of the present invention.

FIG. 2 shows a front structure of an indoor unit of an air conditioner according to a first embodiment of the present invention.

Referring to FIG. 2, an indoor unit 100 of an air conditioner is characterized in that a picture or photograph can be attached to provide an improved outer appearance as well as its basic function of air conditioning.

In detail, the indoor unit 100 includes a front frame 140 and a panel member having a front cover 110 and a decoration panel 120. The front cover 110 is rotatably attached to the front frame 140 such that it can be rotated in a vertical or horizontal direction. The front cover 110 may be attached to the front frame 140 using hinges 145 for allowing vertical or horizontal rotation of the attached front cover 110. The front frame 140 defines a panel receiving portion 141 recessed from a front surface to receive the decoration panel 120. Further, the front frame 140 defines a filter insertion slot 142 above the panel receiving portion 141 to receive a filter such as a hepa filter 130. To prevent the front cover 110 from shaking when it is closed, magnets can be mounted on a rear surface of the front cover 110 and/or a front surface of the front frame 140.

To replace the hepa filter 130 or the decoration panel 120, a user can open the front cover 110 by rotating it about the hinges 145. After replacing the hepa filter 130 or the decoration panel 120, the user can close the front cover 110. The front cover 110 is made of transparent material, such that the decoration panel 120 can be seen when the front cover 110 is closed. Also, a portion of the front cover 110 can be made of opaque material to hide the hepa filter 130 when the front cover 110 is closed.

A reflection plate 147 may be formed at a lower periphery of the front frame 140 where a bottom edge of the decoration panel 120 is located. The reflection plate 290 reflects light to provide visibility of the decoration panel 120 in a dark circumstance.

In detail, a luminous member 150 can be placed behind the reflection plate 147 to illuminate the whole area of the decoration panel 120 by reflecting light from the luminous member 150 toward the decoration panel 120. With the reflection plate 147, the picture or photograph on the decoration panel 120 can be delicately illuminated in a dark circumstance. Therefore, more elegant mood can be provided.

Figure 3:
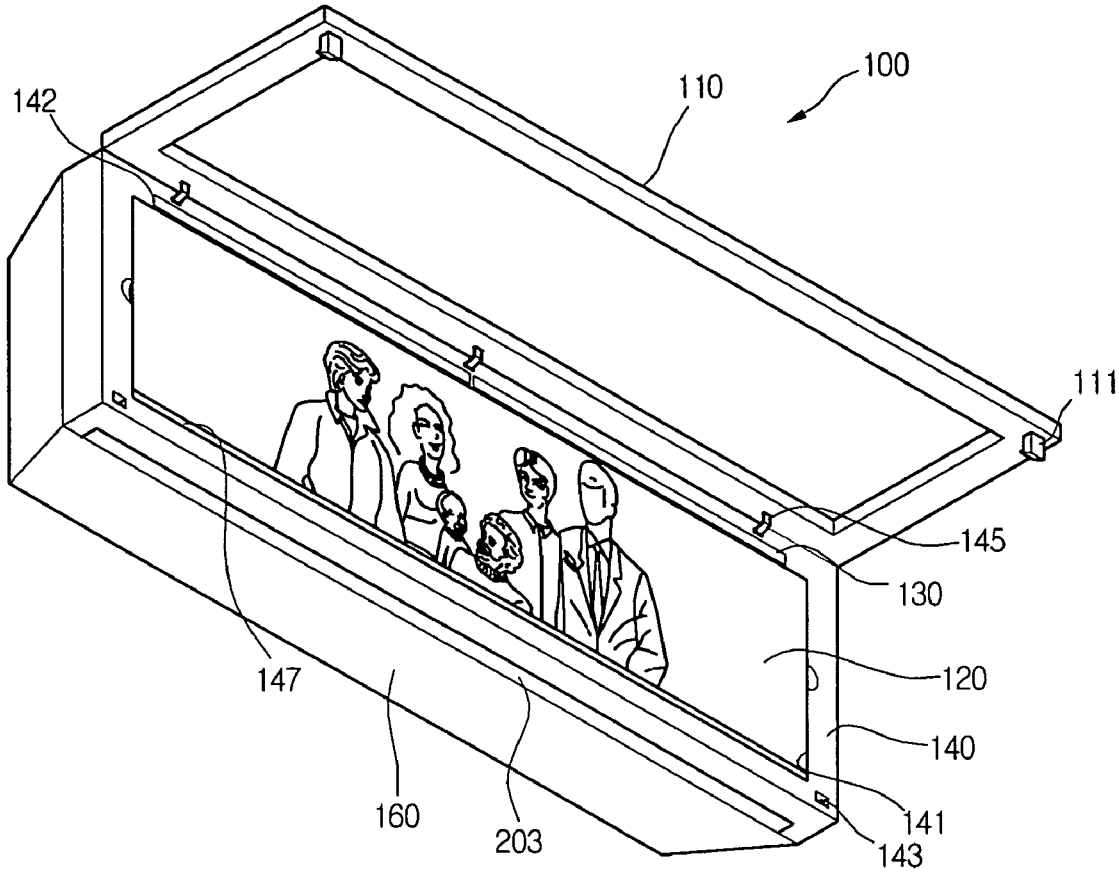
FIG. 3 shows a front structure of an indoor unit of an air conditioner according to a second embodiment of the present invention.

FIG. 3 shows a front structure of an indoor unit of an air conditioner according to a second embodiment of the present invention.

Referring to FIG. 3, a second embodiment of the present invention is characterized in that an indoor unit 100 of an air conditioner employs a hook mechanism to prevent a front cover 110 from shaking when it is closed, instead of using magnets of the first embodiment.

In detail, the front cover 110 includes at least one hook 111 on a rear surface, and a front frame 140 includes a hook insertion hole 341 in a front surface for coupling with the hook 111. The front cover 110 is rotatably attached to the front frame 140 using hinges 145 that are installed on a side opposite to the hook 111. Alternatively, the hook 111 may be formed on a front surface of the front frame 140, and the hook insertion hole 341 may be formed in a rear surface of the front cover 110.

Further, the hinges 145 may be spring hinges with a predetermined elastic force. In this case, the front cover 110 can be automatically opened at a predetermined angle by slightly pressing the closed front cover 110 one time.

For example, the front cover 110 can be automatically opened at 90 degrees by the spring hinges 145, thereby providing easier way of replacing a decoration panel 120. That is, a user does not need to lift up the front cover 110 to open it and replace the decoration panel 120. Here, the front cover 110 and the decoration panel 120 can be referred to as a panel member.

Figure 4:
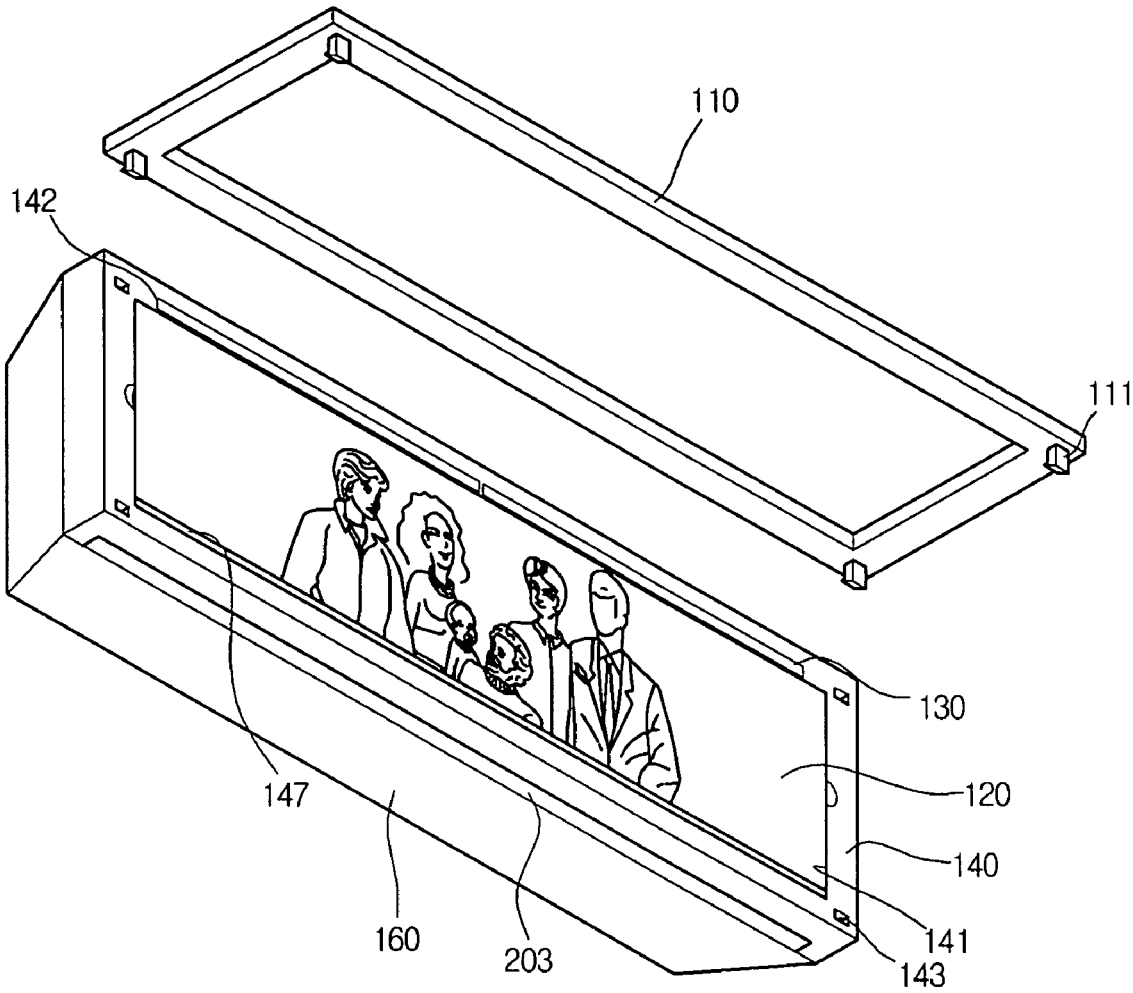
FIG. 4 shows an indoor unit of an air conditioner according to a third embodiment of the present invention.

FIG. 4 shows an indoor unit of an air conditioner according to a third embodiment of the present invention.

Referring to FIG. 4, an indoor unit 100 of an air conditioner is characterized in that a front cover 110 is detachably installed to a front frame 140.

In detail, the indoor unit 100 includes the front frame 140, a panel member, and a base 160. The panel member includes the front cover 110 and a decoration panel 120. The front cover 110 includes a plurality of hooks 111 on a rear surface and a front portion made of transparent material. The front frame 140 defines hook insertion holes 341 in a front surface for coupling with the hooks 111 and a panel receiving portion 141 recessed from a front surface to receive the decoration panel 120. The base 160 is coupled to a back of the front frame 140 to protect inner components. The front frame 140 defines an air outlet in a lower portion. A discharge vane 203 is provided to open and close the air outlet.

To replace the decoration panel 120 or a filter such as a hepa filter 130 installed in an upper portion of the front frame 140, a user can detaches the front cover 110 from the front frame 140. Here, the hooks 111 are formed on four back corners of the front cover 110 to support the front cover 110 with the same force at each the corner.

Further, magnets can be used for the detachable installation of the front cover 110 instead of the hooks 111. In this case, the magnetic force of the magnets is adjusted to prevent the front cover 110 from separating and falling down by its own weight. On the contrary, a user can easily detach the front cover 110 from the front frame 140 without applying excessive force. Further, a reflection plate 147 is installed in a lower portion of the front frame 140 (i.e., on a lower edge of the decoration panel 120 to diverge light upward from the lower edge of the decoration panel 120 as described above.

Figure 5:
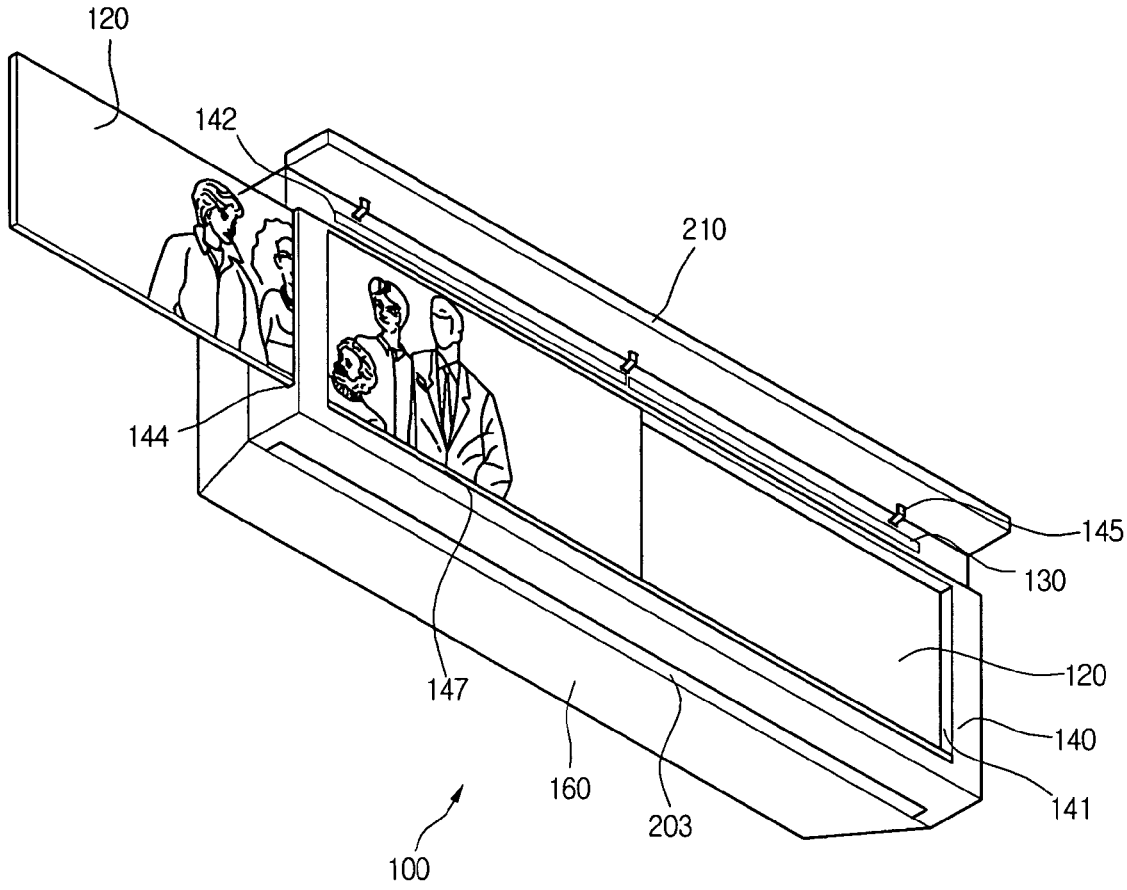
FIG. 5 shows a front structure of an indoor unit of an air conditioner according to a fourth embodiment of the present invention.

FIG. 5 shows a front structure of an indoor unit of an air conditioner according to a fourth embodiment of the present invention.

Referring to FIG. 5, an indoor unit 100 of an air conditioner is characterized in that a decoration panel 120 can be installed by inserting it from a side of the indoor unit 100.

The indoor unit 100 includes a front frame 140, a base 160 coupled to a back of the front frame 140, a filter cover 210 for covering a filter such as a hepa filter 130 inserted to an upper portion of the front frame 140, and the decoration panel 120 decorated with a picture of photograph for insertion from a side of the front frame 140.

The front frame 140 includes a panel insertion slot 144 defined in a side portion and a front portion made of transparent material. Therefore, the picture or photograph of the decoration panel 120 can be seen from the outside after the decoration panel 120 is inserted.

Further, the front frame 140 includes a filter insertion slot 142 in an upper portion to receive the hepa filter 130. The filter insertion slot 142 is covered by the filter cover 210 hinged on the front frame 140.

Alternatively, the filter cover 210 may be installed on the front frame 140 using other coupling structures such as a spring hinge structure and a hook structure.

Figure 6:
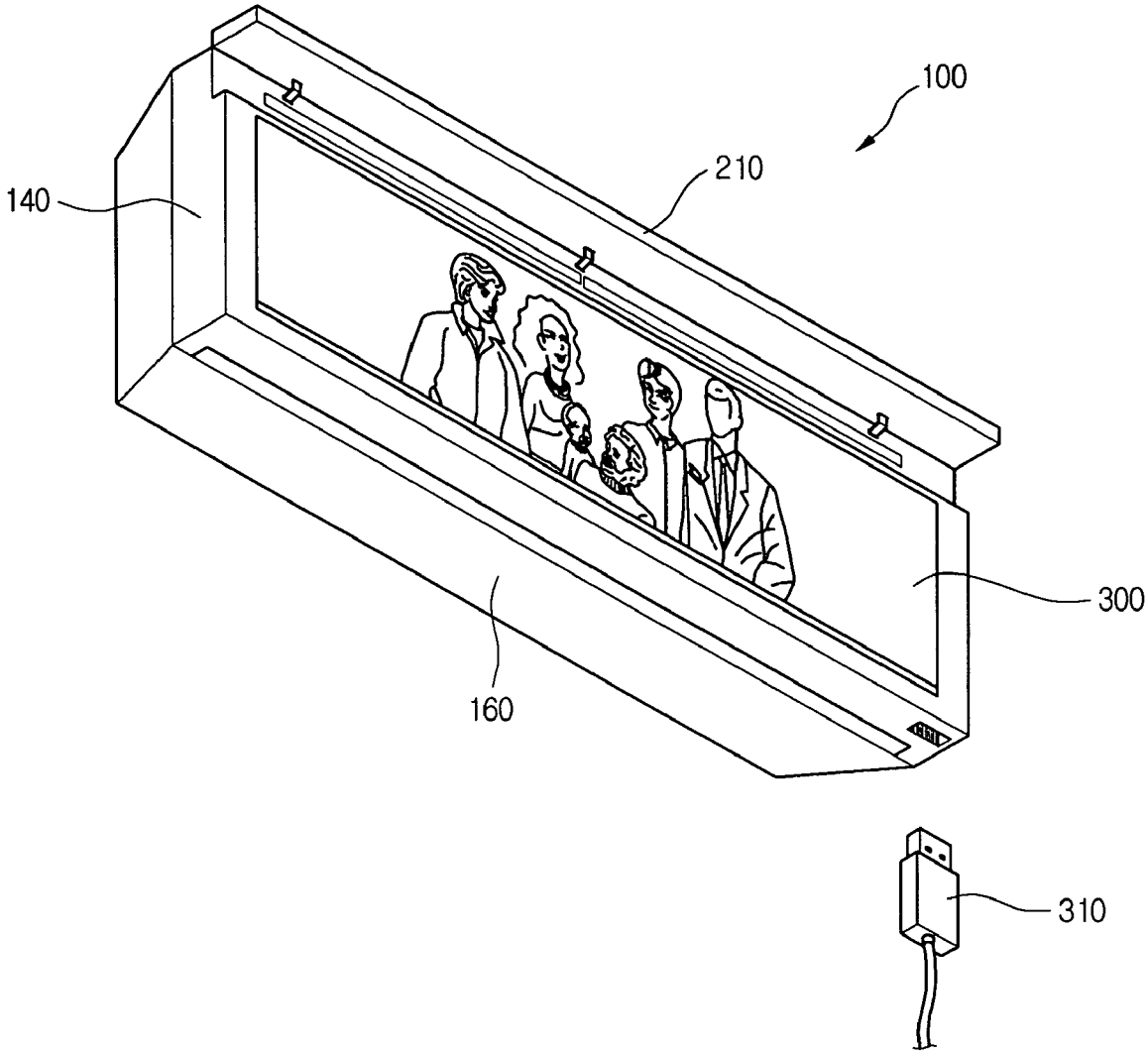
FIG. 6 shows a front structure of an indoor unit of an air conditioner according to a fifth embodiment of the present invention.

FIG. 6 shows a front structure of an indoor unit of an air conditioner according to a fifth embodiment of the present invention.

Referring to FIG. 6, an indoor unit 100 of an air conditioner is characterized in that a front side of a front frame 140 is formed with a display such as an liquid crystal display (LCD), a plasma display panel (PDP), and an organic electroluminescence (EL).

An LCD is a device that generates light and shade effects or displays characters and images by changing molecule arrangement of liquid crystal (a liquid exhibiting properties of a crystal that are not shown by ordinary liquids) sandwiched between two thin glass plates with a voltage applied to the liquid crystal. A PDP is a device that displays color images by discharging mixed gas filled between two thin plates of glass with a voltage applied to the mixed gas. An organic EL means luminescence produced by combinations of electrons and holes (positively charged particles corresponding to the electrons) provided from anode and cathode, or it means display device utilizing the luminescence and it is also called as an organic light emitting diode (OLED).

In detail, the indoor unit 100 includes a display 300 and a data transmission unit such as a cable 310. The cable 310 is connected to the display 300 for sending digital data to the display 300. The display 300 displays digital data received through the cable 310. Therefore, digital images such as pictures and photographs stored in a digital file format can be provided using the display 300 instead of manually attaching a picture or photograph on a front of the indoor unit 100.

For example, a user can store pictures, photographs, or moving pictures on a computer in a file format and transmit the file to the display 300 through the cable 310 for displaying the stored pictures, photographs, or moving pictures. Since the display 300 is provided, a user does not need to manually replace a picture or photograph with new one. That is, the front portion of the indoor unit 100 is used as a monitor.

The display 300 covers the indoor unit 100 from a lower front portion to the filter insertion slot 142. Through the filter insertion slot 142, a filter such as a hepa filter is inserted and a filter cover 210 covers the filter insertion slot 142 as described above.

Figure 7:
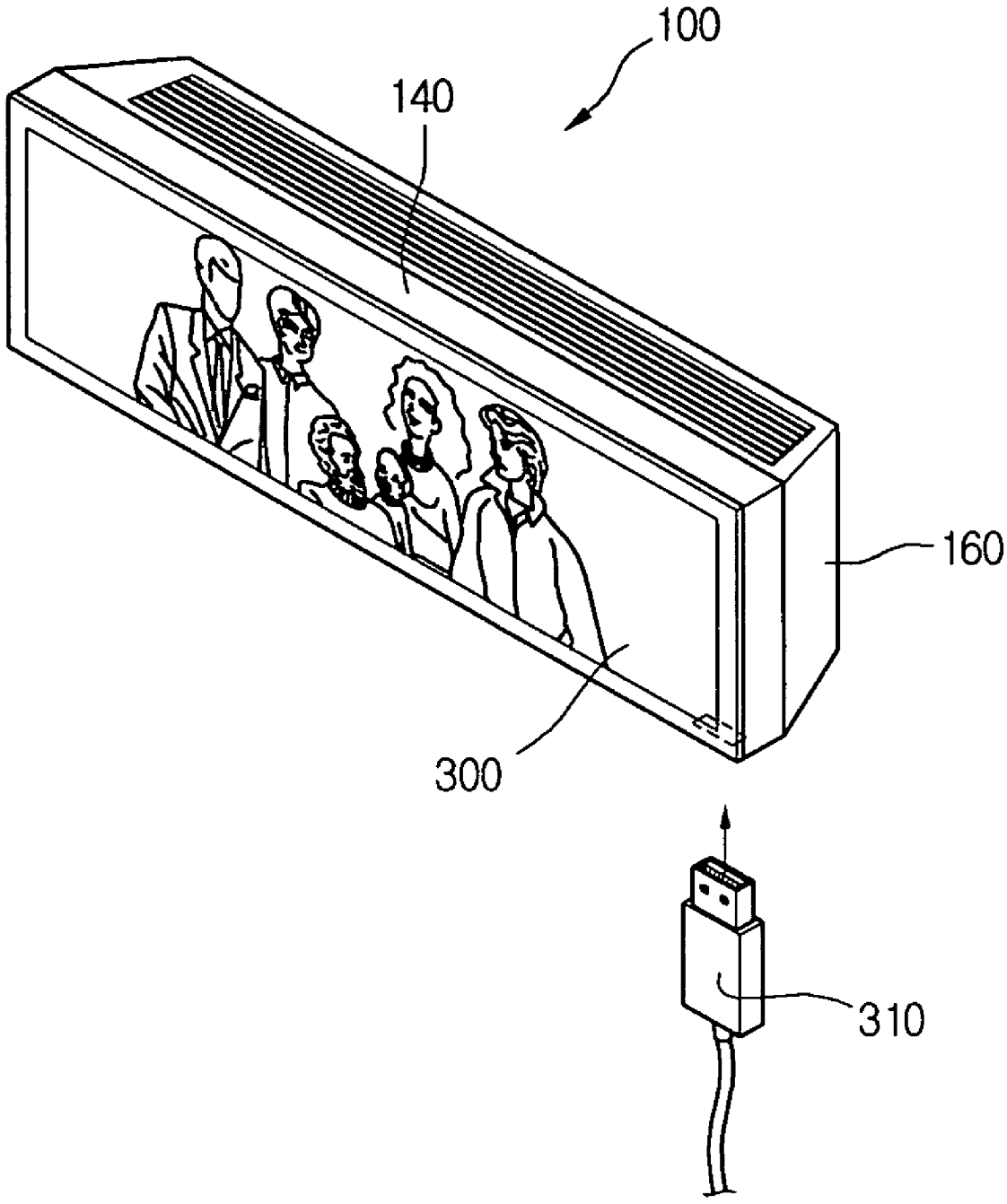
FIG. 7 shows a front structure of an indoor unit of an air conditioner according to a sixth embodiment of the present invention.

FIG. 7 shows a front structure of an indoor unit of an air conditioner according to a sixth embodiment of the present invention.

Referring to FIG. 7, an indoor unit 100 of an air conditioner is characterized in that a display 300 is installed on a front side of a front frame 140 instead of installing a front cover on the front side of the front frame 140.

In detail, the display 300 is used as a front cover and as a digital image display unit. The display 300 may be rotatably installed on the front frame 140 or it may be detachably installed on the front frame 140. Therefore, the display 300 can be rotated open in a vertical direction or horizontal direction, or it can be detached from the front frame 140 for replacing a filter such as a hepa filter 130. Alternatively, the hepa filter 130 may be inserted from an upper lateral portion of the front frame 140. That is, the front frame 140 may define a filter insertion slot in the upper lateral portion and a space inside the filter insertion slot for receiving the hepa filter 130 in a horizontal direction. In this case, the display 300 does not need to be removed or rotated to replace the hepa filter 130.

Digital image signal is transmitted to the display 300 through a data transmission unit such as a cable 310 in the same way described above.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a base;

a front frame coupled to a front of the base and including a filter insertion slot in a predetermined portion;

a filter inserted into the slot in a direction perpendicular to a front surface of the front frame;

a heat exchanger accommodated in the base to exchange heat with sucked air;

a blower fan installed behind the heat exchanger to suck indoor air;

a decoration panel detachably installed on the front surface of the front frame and having a picture or a photograph, the front frame on the front surface having a recess for receiving the decoration panel; and a front cover pivotably coupled to the front frame to cover the decoration panel and the filter insertion slot, and to interchange the decoration panel, wherein at least three edges of the front cover are separated from the front frame in order to interchange the decoration panel and to cover the filter insertion slot.

2. The air conditioner according to claim 1, wherein the filter insertion slot is horizontally defined in an upper portion of the front frame.

3. The air conditioner according to claim 1, further comprising a HEPA filter inserted through the filter insertion slot.

4. The air conditioner according to claim 1, wherein the front frame includes:

a reflection plate installed on a periphery of the panel receiving portion to reflect light.

5. The air conditioner according to claim 1, wherein the front cover is rotatably coupled to the front frame using a hinge.

6. The air conditioner according to claim 1, wherein the front cover is detachably coupled to the front frame.

7. The air conditioner according to claim 1, further comprising a magnet installed to a predetermined portion of the front cover and/or the front frame for controlling rotational motion and/or detachment of the front cover.

8. The air conditioner according to claim 1, wherein the front cover is rotatably or detachably installed to the front frame using a hook structure.

9. The air conditioner according to claim 1, further comprising a luminous member installed in a space defined by the front frame and the base to emit light.

10. The air conditioner according to claim 1, wherein the base defines an air intake in a predetermined portion, and the front frame defines an air outlet in a predetermined portion.

* * * * *

UNITED STATES PATENT AND TRADEMARK OFFICE

CERTIFICATE OF CORRECTION

PATENT NO. : 7,650,709 B2
APPLICATION NO. : 11/326395
DATED : January 26, 2010
INVENTOR(S) : Ji Hoon Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 888 days.

Signed and Sealed this

Twelfth Day of October, 2010

David J. Kappos

David J. Kappos
*Director of the United States Patent and Trademark Office*